US009215923B1

(12) United States Patent
Boone

(10) Patent No.: US 9,215,923 B1
(45) Date of Patent: Dec. 22, 2015

(54) PORTABLE TABLE APPARATUS

(71) Applicant: Kermit Chair Company, LLC, Nashville, TN (US)

(72) Inventor: Luther Boone, Red Boiling Springs, TN (US)

( * ) Notice: Subject to any disclaimer, the term of this patent is extended or adjusted under 35 U.S.C. 154(b) by 0 days.

(21) Appl. No.: 14/320,517

(22) Filed: Jun. 30, 2014

(51) Int. Cl.

| | |
|---|---|
| ***A47B 3/04*** | (2006.01) |
| ***A47B 3/06*** | (2006.01) |
| ***A47B 13/00*** | (2006.01) |
| ***A47B 13/08*** | (2006.01) |

(52) U.S. Cl.
CPC ..... *A47B 3/06* (2013.01); *A47B 13/003* (2013.01); *A47B 13/08* (2013.01)

(58) Field of Classification Search
CPC ..... F16B 12/22; F16B 12/34; F16B 12/44; A47B 13/04; A47B 3/06; A47B 2013/006; A47B 13/003
USPC ..... 248/165, 150; 108/153.1, 154, 155, 108/156, 157.1, 157.16, 157.18, 159, 158, 108/158.11, 158.12, 67
See application file for complete search history.

(56) References Cited

U.S. PATENT DOCUMENTS

| | | | | | |
|---|---|---|---|---|---|
| 616,337 | A * | 12/1898 | Kuhn | 108/155 |
| 813,257 | A * | 2/1906 | Tarr | 108/62 |
| 1,094,900 | A * | 4/1914 | Holt | 403/264 |
| 1,104,018 | A * | 7/1914 | Thiss | 108/155 |
| 1,148,070 | A * | 7/1915 | Billingsley | 108/154 |
| 1,216,079 | A * | 2/1917 | Cook | 108/155 |
| 1,262,356 | A * | 4/1918 | Kirkland | 108/171 |
| 1,675,827 | A * | 7/1928 | Shrader | 108/156 |
| 4,765,253 | A * | 8/1988 | Schappach | 108/158.12 |
| 5,056,439 | A * | 10/1991 | Hodge et al. | 108/34 |
| 8,383,224 | B2 * | 2/2013 | Heal | 428/67 |
| 2010/0209656 | A1 * | 8/2010 | Heal | 428/99 |

* cited by examiner

*Primary Examiner* — Janet M Wilkens
(74) *Attorney, Agent, or Firm* — Mark A. Pitchford; Waller Lansden Dortch & Davis

(57) ABSTRACT

A table apparatus and method of constructing the same including a table top having a plurality of slots, a plurality of legs, each of the legs inserted into a corresponding slot, and a support brace having a first longitudinal slot and a second longitudinal slot, the first longitudinal slot having a longitudinal length greater than a longitudinal length of the second longitudinal slot. A first leg of the plurality of legs is positioned in the first longitudinal slot. A second leg in the plurality of legs is positioned in the second longitudinal slot. The first leg can have a first bolt, the first bolt positioned to extend through a first slot of the plurality of slots and the first longitudinal slot. The second leg can have a second bolt, the second bolt configured to extend through a second slot of the plurality of slots and the second longitudinal slot.

18 Claims, 6 Drawing Sheets

PORTABLE TABLE APPARATUS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to a portable table apparatus.

More particularly, the present invention relates to a table apparatus that can be disassembled and reassembled to provide a convenient table that can be carried with the user to various locations. Conventional solutions include a table top with a plurality of legs that can be screwed and unscrewed from the table top. To transport the table, the legs are unscrewed from the table top, and the legs and table top are stored in a bag or other carrying device to be transported to a different location, or to be stored when the table is not in use. However, such solutions include legs with long bolts or screws extending from the legs. The bolts or screws must be fully screwed into the table top, which can take a considerable amount of time and effort, which can be undesirable.

Additionally, some conventional solutions include support braces that reinforce the legs of the table apparatus. However, these support braces include lateral or transverse slats which receive the legs of the table. A lateral slat in the support brace can make the support brace more likely to fatigue or break along the slat, which can be undesirable as the support braces may need to be replaced often.

What is needed then are improvements in portable tables.

BRIEF SUMMARY OF THE INVENTION

Aspects of the present invention provide a portable table apparatus that can be disassembled and reassembled such that a user can conveniently transport the table apparatus to various locations.

In one aspect, the table apparatus includes a table top having a plurality of slots. The table apparatus includes a plurality of legs, each of the plurality of legs being inserted into a corresponding slot in the table top. The table apparatus includes a support brace having a first end including a first longitudinal slot and a second end including a second longitudinal slot. The first longitudinal slot has a longitudinal length greater than a longitudinal length of the second longitudinal slot. A first leg of the plurality of legs can be positioned in the first longitudinal slot, and a second leg of the plurality of legs can be positioned in the second longitudinal slot.

In some embodiments, the first leg includes a first bolt, the first bolt configured to extend through a first slot in the plurality of slots in the table top, the first bolt additionally configured to be received by the first longitudinal slot of the support brace. The second leg can include a second bolt, the second bolt configured to extend through a second slot of the plurality of slots in the table top, the second bolt additionally configured to be received by the second longitudinal slot of the support brace.

In some embodiments, the table top includes a plurality of slats oriented substantially perpendicular to each other, the plurality of slats being connected to one another by at least one strap attached to one side of the plurality of slats. The table top can be operable to roll up when detached from the first and second legs and the support brace. As such, the table apparatus can be stored in a relatively small amount of space.

Another aspect of the present invention is a method for constructing a table apparatus including a table top with a plurality of slots, a plurality of legs, and a support brace having a first end with a first longitudinal slot and a second end with a second longitudinal slot, the first longitudinal slot having a longitudinal length greater than a longitudinal length of the second longitudinal slot. The method includes the steps of inserting a first leg of the plurality of legs into a first slot of the plurality of slots in the table top, inserting the first leg into the first longitudinal slot of the support brace, inserting a second leg of the plurality of legs into a second slot of the plurality of slots in the table top, and inserted the second leg into the second longitudinal slot of the support brace, such that the support brace extends across a plurality of slats of the table top.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
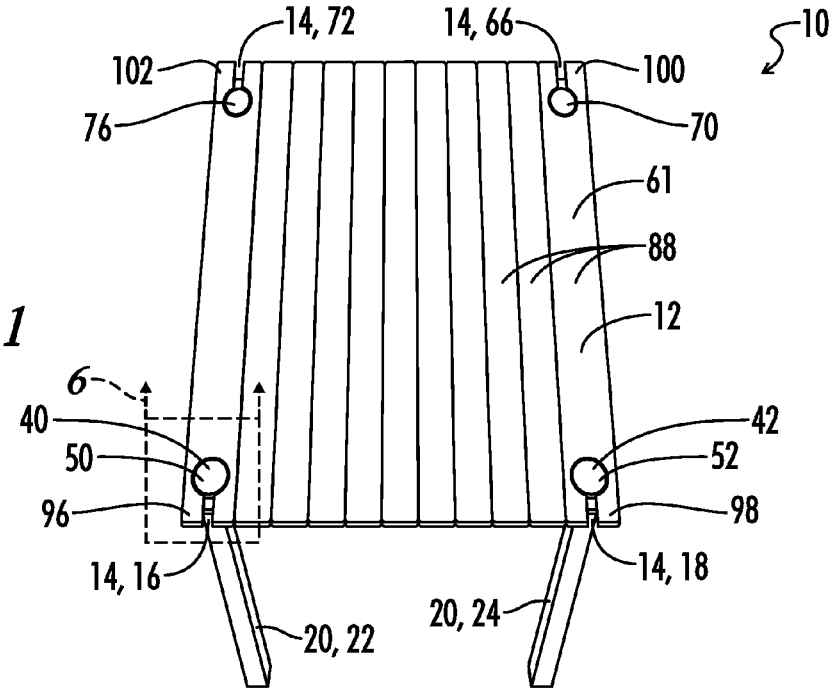
FIG. 1 is a top perspective view of an embodiment of a table apparatus of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

A perspective view of a first embodiment of the present invention is shown in FIG. 1. A table apparatus 10 includes a table top 12. The table top 12 can includes a plurality of slots 14. The plurality of slots 14 includes a first slot 16 and a second slot 18. The table apparatus 10 can also include a plurality of legs 20, each of the plurality of legs inserted into a corresponding slot 14 in the table top 12. The plurality of legs can include a first leg 22 and a second leg 24. The first leg 22 can be inserted in the first slot 16, and the second leg 24 can be inserted in the second slot 18.

Figure 2:
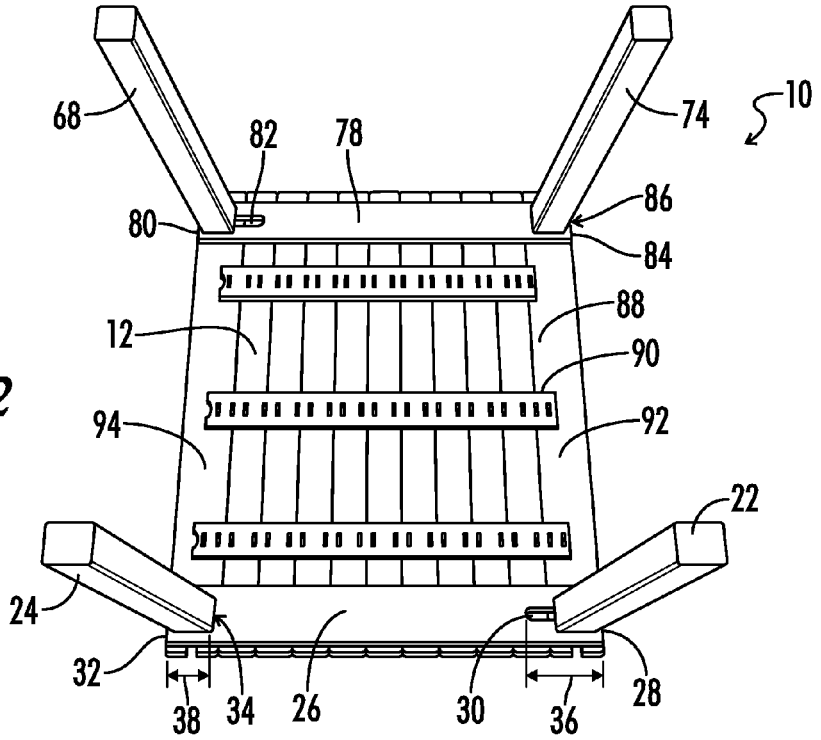
FIG. 2 is a bottom perspective view of the table apparatus of FIG. 1.

As can be seen from FIG. 2, the table apparatus 10 can include a support brace 26. The support brace 26 can have a first end 28 having a first longitudinal slot 30, and a second end 32 having a second longitudinal slot 34. The first longitudinal slot 30 can have a longitudinal length 36 greater than a longitudinal length 38 of the second longitudinal slot 34. The first leg 22 can be positioned in the first longitudinal slot 30, and the second leg 24 can be positioned in the second longitudinal slot 34. The support brace 26 can help provide strength and rigidity to the table apparatus 10 and can also help structurally reinforce the connection between the first and second legs 22 and 24 and the table top 12.

Some conventional solutions include support braces that include lateral slats in the support braces. However, such lateral slats can make the support braces more prone to fatigue and breaking, which can be undesirable. The longitudinal slots 30 and 34 in the support brace 26 can help make the support brace 26 more resistant to fatigue and breaking.

Figure 3:
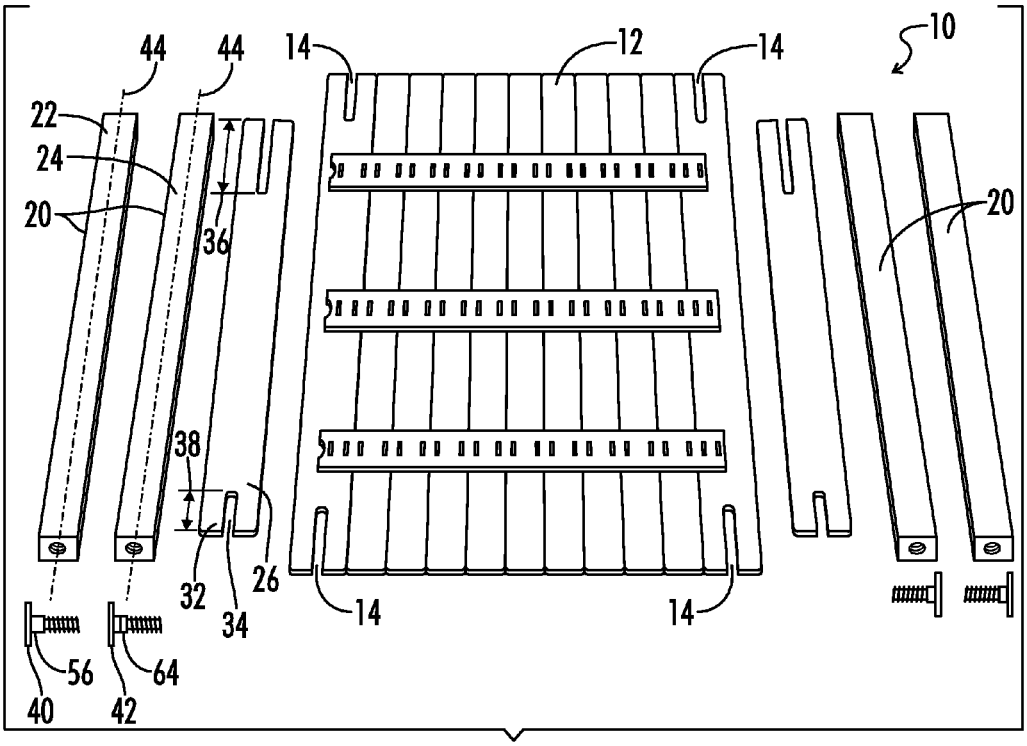
FIG. 3 is a dissembled view of the table apparatus of FIG. 1.

A disassembled view of the table apparatus of FIG. 1 can be seen in FIG. 3. In some embodiments, the first leg 22 can include a first bolt 40, and the second leg 24 can include a second bolt 42. In some embodiments, the first and second legs 22 and 24 can each include a longitudinal axis 44, the first and second legs 22 and 24 extending along their respective longitudinal axes. The first bolt 40 can extend longitudinally from or along a longitudinal axis of the first leg 22, and the second bolt 42 can extend longitudinally from or along a longitudinal axis of the second leg 24. As can be seen in FIG. 1, in some embodiments the first bolt 40 can configured to extend through the first slot 16 such that the first bolt 40 is positioned in the first slot 16. Similarly, the second bolt 42 can be configured to extend through the second slot 18 such that the second bolt 42 is positioned in the second slot 18. The first slot 16 has a width that is bigger than at least a portion of the first bolt 40, and the second slot 18 has a width that is bigger than at least a portion of the second bolt 42.

As can be seen from FIG. 2, the first longitudinal slot 30 of the support brace 26 can be configured to receive the first bolt 40 of the first leg 22 such that the first bolt 40 is positioned in the first longitudinal slot 30. Similarly, the second longitudinal slot 34 of the support brace 26 can be configured to receive the second bolt 42 such that the second bolt 42 is positioned in the second longitudinal slot 34. The first longitudinal slot 30 has a width that is bigger than at least a portion of the first bolt 40, and the second longitudinal slot 34 has a width that is bigger than at least a portion of the second bolt 42. As such, the first and second bolts 40 and 42 can each be positioned within their corresponding slots in the table top 12 as well as their corresponding longitudinal slots in the support brace 26, effectively joining the table top 12 and the support brace 26 to each of the first and second legs 22 and 24. In some embodiments, the support brace 26 can be configured to be positioned between the table top 12 and the first leg 20 and the table top 12 and the second leg 24. In such a configuration, the support brace 26 is not visible when the table apparatus 10 is viewed from above.

Figure 4:
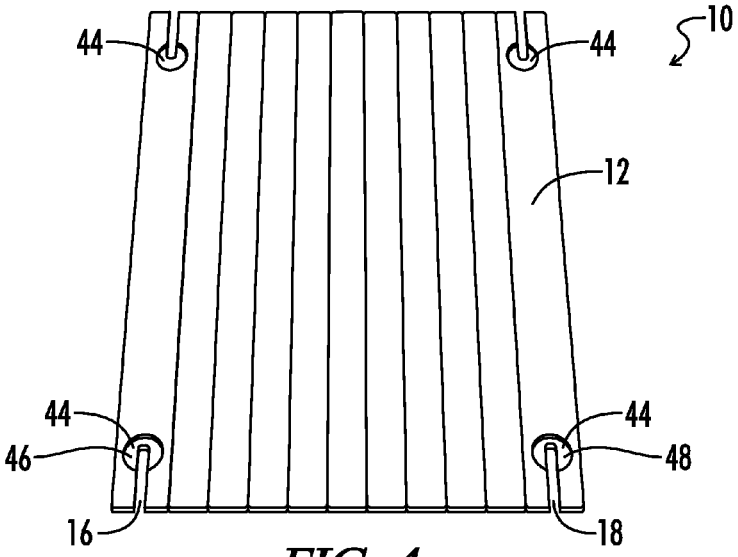
FIG. 4 is a top perspective view of the table top of the table apparatus of FIG. 1.

As can be seen in FIG. 4, in some embodiments, the table top 12 can include a plurality of recesses 44. The plurality of recesses 44 can include a first recess 46 and a second recess 48, the first slot 16 coincident extending into or coincident with the first recess 46, and the second slot 18 extending into or coincident with the second recess 48. As can be seen from FIG. 1, the first bolt 40 can include a first bolt head 50, and the second bolt 42 can include a second bolt head 52. The first recess 46 can be configured to receive the first bolt head 50, and the second recess 48 can be configured to receive the second bolt head 52. The first bolt 40 can be positioned in the first slot 16 such that the first bolt head 50 is positioned in the first recess 46. The second bolt 42 can be positioned in the second slot 18 such that the second bolt head 52 is positioned in the second recess 48. Having the bolt heads 50 and 52 positioned within their respective recesses 46 and 48 can help prevent the first and second bolts 40 and 42 from sliding within the first and second slots 16 and 18 respectively, which can help provide increased rigidity and structure to the table apparatus 10.

In some embodiments, the bolts 40 and 42 in the legs 22 and 24 can be configured to extend a predetermined distance from the legs 22 and 24 such that when the bolts 40 and 42 are positioned in the corresponding slots 16 and 18 in the table top 12 and the longitudinal slots 30 and 34 in the support brace 26, an interference fit can be formed between the table top 12, the support brace 26, and the first and second legs 22 and 24. The interference fit can produce a tight joining of the table top 12, the support brace 26, and the first and second legs 22 and 24.

In other embodiments, the first and second bolts 40 and 42 can be threaded into the first and second legs 22 and 24 respectively. A first leg 22 with a threaded first bolt 40 can be seen in FIG. 5. The threaded first bolt 40 can have threads 54 which can be predrilled into the first leg 22. The first bolt 40 can then be adjustable within the first leg 22 such that the first bolt 42 can selectively clamp the first leg 22, the support brace 26, and the table top 12 together. When the first bolt 42 is positioned in the first slot 16 and the first longitudinal slot 30, the first bolt 40 can then be tightened to insert the first bolt 40 further into the first leg 22, thereby clamping the first leg 22, the table top 12, and the support brace 26 together. The first bolt 40 can then be loosened in order to remove the first bolt 40 from the first slot 16 and the first longitudinal slot 30 when the table apparatus 10 is being taken apart. Similarly, the second bolt 42 can also be threaded into the second leg 24 such that the second bolt 42 can be adjustable within the second leg 24 such that the second bolt 42 can selectively clamp the second leg 24, the table top 12, and the support brace 26 together.

Such a configuration with a threaded bolt predrilled into each leg of the table apparatus can help reduce the time required for assembling the table apparatus 10. In conventional tables, a bolt or screw is drilled into each leg. A corresponding threaded hole is predrilled into the table top. The bolt or screw in the leg must then be screwed into the corresponding hole in the table. In such an embodiment, a significant portion of the bolt or screw must be screwed into the table top, which can take substantial time and effort. In the embodiment shown in FIG. 1 with predrilled bolts in each leg and slots in the table top 12, the bolts 40 and 42 can be inserted into the slots and then can be screwed into the legs only a small distance in order to clamp the table top 12, the support brace 26, and the legs 22 and 24 together. Such a configuration can help reduce assembly time, as well as disassembly time, for the table apparatus 10.

The first leg can be configured to selectively clamp the support brace 26 between the table top 12 and the first leg 22, and the second leg 24 can be configured to selectively clamp the support brace 26 between the table top 12 and the second leg 24. The legs have been previously described as used threaded bolts which can be selectively tightened to achieve clamping of the table top 12, the support brace 26, and the first and second legs 22 and 24. However, any suitable clamping means can be used to achieve the same result, including but not limited to spring bolts that can be pulled to insert the bolts into their respective slots, the bolts being released to clamp the corresponding components together.

Figure 6:
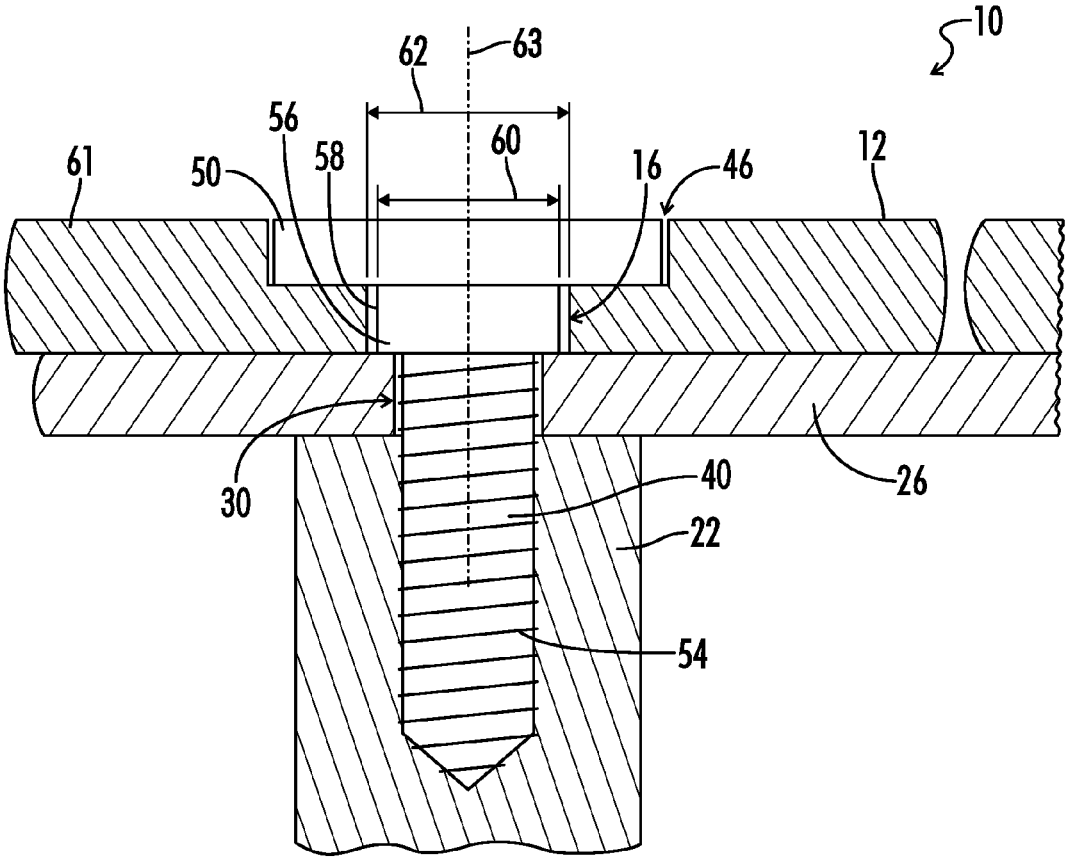
FIG. 6 is a cross sectional view of the joining of the table top, the support brace, and a leg of the table apparatus of FIG. 1.

A detailed view of the joining of the table top 12, the support brace 26, and the first leg 22 is shown in FIG. 6. In some embodiments, the first bolt 40 can include a first angular stop portion 56. The first angular stop portion 56 can correspond to the first slot 16. In some embodiments, the first angular stop portion 56 can be complementary to the first slot 16. When the first bolt 40 is positioned in the first slot 16 and the first bolt head 50 is positioned in the first recess 46, the first angular stop portion 56 can correspond to the first slot 16 such that the first slot 16 prevents the first bolt 40 from rotating about an axis 63 perpendicular to the plane 61 of the table top 12.

Figure 5:
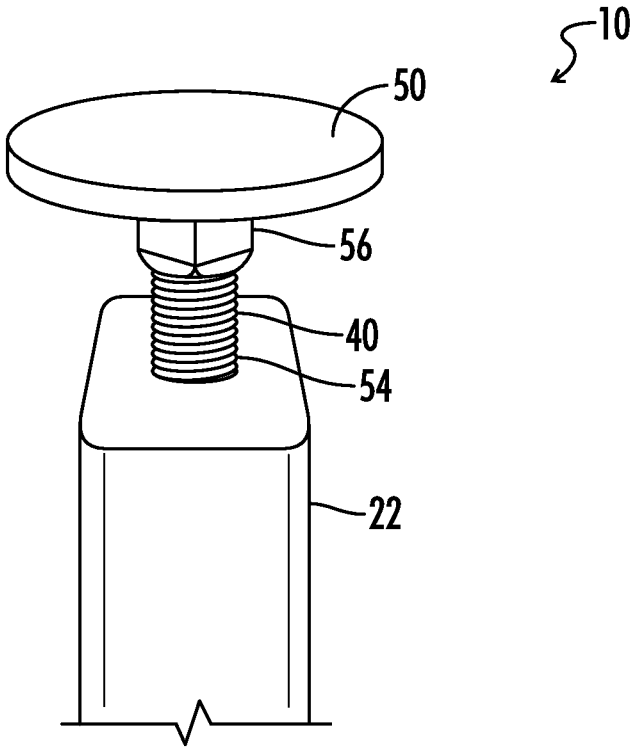
FIG. 5 is a detailed view of a bolt extending from a leg of the table apparatus of FIG. 1.

As can be seen from FIG. 5 and FIG. 6, the first angular stop portion 56 in some embodiments can have a generally square shape. A side 58 of the first angular stop portion 56 can have a lateral width 60 that generally corresponds to a lateral width 62 of the first slot 16. A diagonal of the first angular stop portion 56 is larger than the width 62 of the first slot 16 such that the first angular stop portion 56 prevents the first bolt 40 from rotating about the axis perpendicular to the plane of the table top 12. While the first angular stop portion 56 in FIG. 6 has a generally square shape, in other embodiments the first angular stop portion 56 can have any suitable shape or orientation such that the first angular stop portion 56 engages a side wall of the first slot 16. Such shapes may include, but are not limited to, hexagonal, triangular, rectangular, oval, etc.

As such, when the first angular stop portion 56 is positioned in the first slot 16 and the bolt is torqued, for instance when the first leg 22 is rotated, the angular stop portion 56 engages the side wall of the first slot 16, thereby preventing the first bolt 40 from rotating within the first slot 16 about the perpendicular axis 63. As the first leg 22 is rotated in one direction, the first bolt 40 can be further screwed or tightened into the first leg 22, effectively clamping the table top 12, the support brace 26, and the first leg 22 together. When the first leg 22 is subsequently rotated in an opposite direction, the first angular stop portion 56 again can prevent the first bolt 40 from rotating about the perpendicular axis 63, causing the first bolt 40 to be unscrewed or loosened from the first leg 22, effectively unclamping the table top 12, the support brace 26, and the first leg 22.

As can be seen in FIG. 3, the second bolt 42 can similarly include a second angular stop portion 64 that corresponds to the second slot 18 such that the second slot 18 prevents the second bolt 42 from rotating about an axis perpendicular to the plane 61 of the table top 12. The second angular stop portion 64 can prevent the second bolt 42 from rotating as described within the second slot 18 when the second angular stop portion 64 is inserted into the second slot 18.

Referring now to FIG. 1 and FIG. 2, in some embodiments the table apparatus 10 can include a third slot 66 and a fourth slot 72 in the table top 12. The first slot 16 can be located at a first corner 96 of the table top 12. The second slot 18 can be located at a second corner 98 of the table top 12. The third slot 66 can be located at a third corner 100 of the table top 12. The fourth slot 72 can be located at a fourth corner 102 of the table top 12. As such, the table top 12 can have a substantially rectangular shape. The apparatus can include a third leg 68 having a third bolt 70, the third slot 66 configured to receive the third bolt 70 therethrough. The apparatus 10 can include a fourth leg 74 having a fourth bolt 76, the fourth slot 72 configured to receive the fourth bolt 76.

The table apparatus 10 can include a second support brace 78, the second support brace 78 having a first end 80 with a first longitudinal slot 82 and a second end 84 with a second longitudinal slot 86. The first longitudinal slot 82 of the second support brace 78 can have a longitudinal length greater than a longitudinal length of the second longitudinal slot 86 of the second support brace 78. The first longitudinal slot 82 of the second support brace 78 can be configured to receive the third bolt 70 such that the third bolt 70 is positioned in the first longitudinal slot 82 of the second support brace 78. The second longitudinal slot 86 of the second support brace 78 can be configured to receive the fourth bolt 76, such that the fourth bolt 76 can be positioned in the second longitudinal slot 86 of the second support brace 78.

As such, the table apparatus 10 shown in FIG. 2 can include two pairs of legs joined to the table top 12, with a support brace joining each corresponding pair of legs. In some embodiments, the third and fourth legs 66 and 74 are positioned generally opposite the first and second legs 22 and 24. In other embodiments, the table apparatus 10 can include only three legs, with one pair of legs being joined by a support brace 26, the three legs forming a tripod to support the table top 12. It will be apparent to one skilled in the art that additional pairs of legs and a corresponding support braces as previously described can be included in the table apparatus as needed, for instance to further support a table apparatus of increased size or weight.

In some embodiments, the table top 12 can include a plurality of slats 88 oriented substantially parallel to one another. Each of the plurality of slats 88 can be connected to each other by at least one strap 90 attached to one side of the plurality of slats 88. As such, the table top 12 can be operable to roll up when detached from the first and second legs 22 and 24 and the support brace 26. The table top 12 can then roll up into a compact storage configuration such that the table top 12 along with the legs and support braces can be stored in a relatively small amount of space. The ability to store the table apparatus 10 in a small amount of space can provide a portable table apparatus that can conveniently be transported to different locations, or a table apparatus that can be easily and efficiently stored without requiring a large amount of space. Such a portable table may be beneficial for a variety of different users, including but not limited to, campers, hikers, backpacker, boaters, tailgaters, concert goers, etc.

In some embodiments, the support brace 26 can be oriented substantially transverse to the plurality of slats 88 in the table top 12 when the first bolt 40 is extending through the first longitudinal slot 30 of the support brace 26 and the first slot 16 of the table top 12, and the second bolt 42 is extending through the second longitudinal slot 34 in the support brace 26 and the second slot 18 in the table top 12. As such, when the table top 12 is unrolled and the support brace 26 is in position, the support brace can maintain the plurality of slats 88 in an unrolled, flat, or rigid position. In some embodiments, the plurality of slats can include a first outer slat 92 and a second outer slat 94. The first slot 16 can be located in the first outer slat 92 and the second slot 18 can be located in the second outer slat 94 such that the first outer slat 92 and the second outer slat 94 form opposing ends of the table top 12. As such, when the support brace 26 is in position and receives the first and second legs 22 and 24, the support brace 26 can traverse and thereby support all of the slats in the plurality of slats 88.

Another aspect of the present invention is a method of constructing a table apparatus. As can be seen in FIG. 3, the disassembled table apparatus can include a table top 12 having a plurality of slots 14, a plurality of legs 20, and a support brace 26 having a first end 28 with a first longitudinal slot 30 and a second end 32 with a second longitudinal slot 34, the first longitudinal slot 30 having a longitudinal length longer than a longitudinal length of the second longitudinal slot 34.

Figure 7:
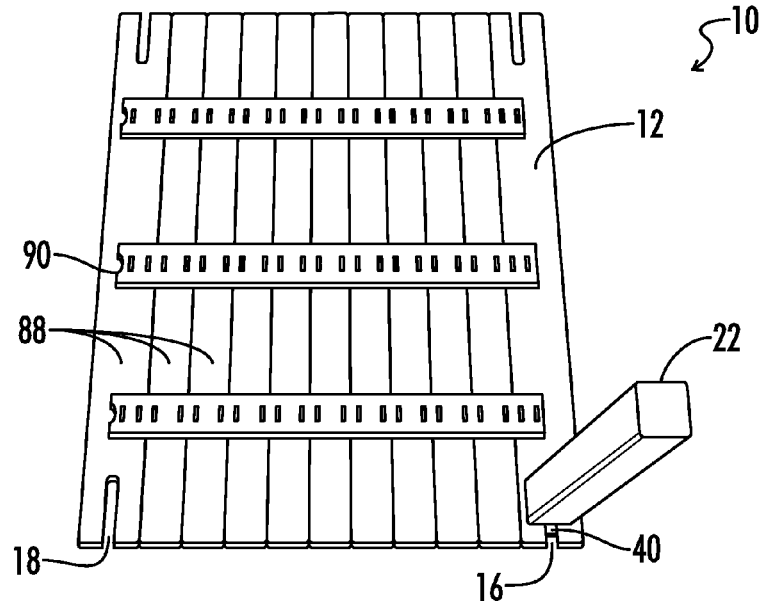
FIG. 7 is a bottom perspective view of a first leg being inserted into a first slot in the table top of the table apparatus of FIG. 1.
Figure 8:
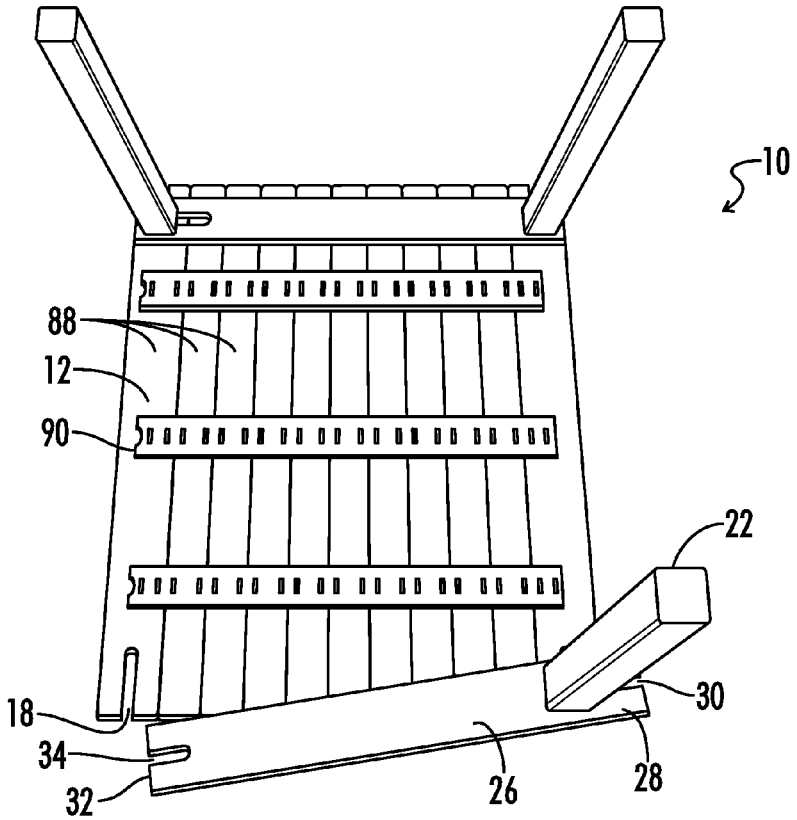
FIG. 8 is a bottom perspective view of a support brace sliding into a first leg of the table apparatus of FIG. 1.
Figure 9:
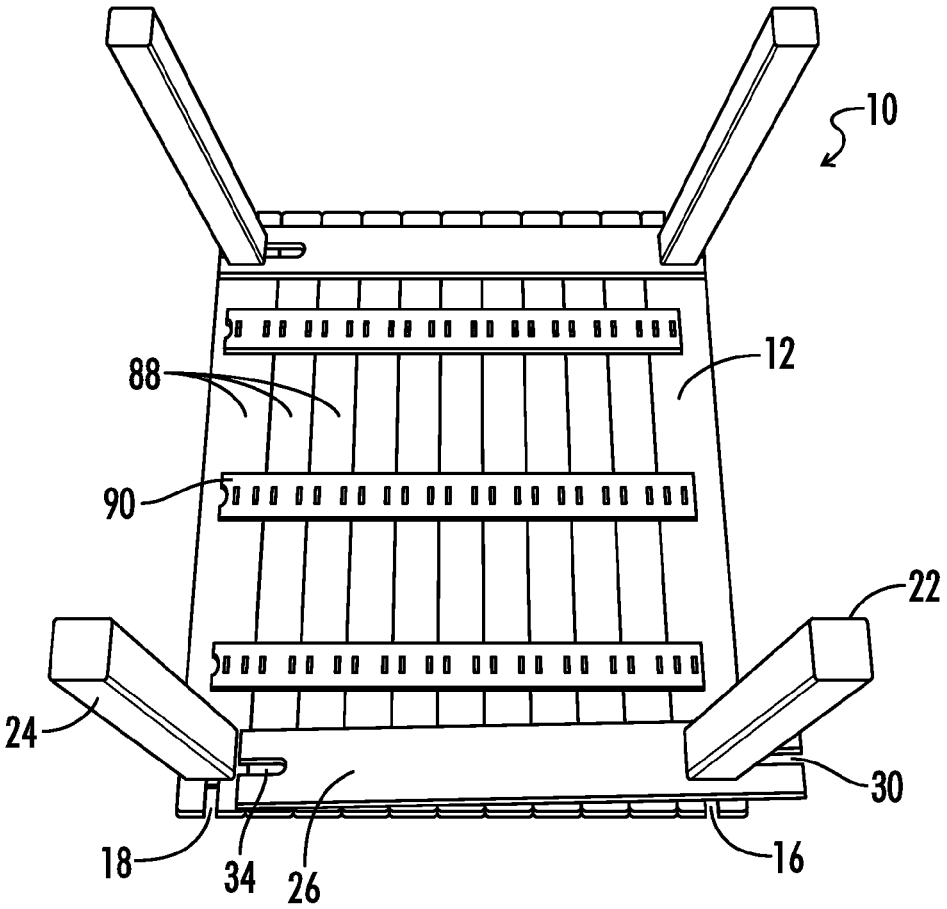
FIG. 9 is a bottom perspective view of a second leg being inserted into a second slot in the table top of the table apparatus of FIG. 1.

One step of the method is shown in FIG. 7. A first leg 22 of the plurality of legs 14 can be inserted into a first slot 16 of the plurality of slots 14. Another step of the method can be shown in FIG. 8. The first leg 22 can be inserted into the first longitudinal slot 30 of the support brace 46. Another step of the method can be shown in FIG. 9. A second leg 24 of the plurality of legs can be inserted into a second slot 18 of the plurality of slots 14 in the table top 12. From FIG. 9 it can be seen that because the first longitudinal slot 30 in the support brace 26 has a greater longitudinal length, the support brace 26 can slide onto the first leg 22 along the first longitudinal slot 30 such that sufficient clearance can be formed between the support brace 26 and the second leg 24 being inserted into the second slot 18 of the table top 12. Another step of the method includes inserting the second leg 24 into the second longitudinal slot 34 of the support brace 26 such that the support brace 26 extends across a plurality of slats 88 in the table top 12. A constructed table can then be formed similar to the table shown in FIG. 1 and FIG. 2. It will be readily apparent to one in the art that the second and third steps can be done in either order, or that in some embodiments, the second leg 24 is inserted into the second slot 18 before the support brace 26 is slid onto the first leg 22.

In some embodiments of the method, the first leg 22 includes a first bolt 40, and the second leg 24 includes a second bolt 24. In such embodiments, the step of inserting the first leg 22 into the first slot can 16 further include inserting the first bolt 40 into the first slot 16, and the step of inserting the first leg 22 into the first longitudinal slot 30 can further include the first longitudinal slot 30 receiving the first bolt 40. Similarly, the step of inserting the second leg 24 into the second slot 18 can further include inserting the second bolt 42 into the second slot 18, and the step of inserting the second leg 24 into the second longitudinal slot 34 can further include the second longitudinal slot 234 receiving the second bolt 40. The method can also further include centering the support brace 26 between opposing ends of the table top 12, tightening the first bolt 40 to clamp the first leg 22, the table top 12, and the support brace together, and tightening the second bolt 42 to clamp the second leg 24, the table top 12, and the support brace 26 together.

In some embodiments the table top 12 can further include a plurality of slats 88 oriented substantially parallel to one another, the plurality of slats 88 connected together by a strap 90 attached to one side of each of the plurality of slats 88, the slats operable to roll up on one another. For such an embodiment, the method can further include the step of unrolling the table top 12.

Thus, although there have been described particular embodiments of the present invention of a new and useful PORTABLE TABLE APPARATUS it is not intended that such references be construed as limitations upon the scope of this invention except as set forth in the following claims.

What is claimed is:

1. A table apparatus comprising:

a table top having a first slot and a second slot;

a first leg having a first bolt, wherein the first bolt is configured to extend through the first slot in the table top;

a second leg having a second bolt, wherein the second bolt is configured to extend through the second slot in the table top; and a support brace having a first end with a first longitudinal slot and a second end with a second longitudinal slot, the first longitudinal slot having a longitudinal length greater than a longitudinal length of the second longitudinal slot, wherein the first longitudinal slot is configured to receive the first bolt of the first leg therethrough, and the second longitudinal slot is configured to receive the second bolt of the second leg therethrough, wherein the table top includes a plurality of slats oriented substantially parallel to one another, and the plurality of slats are connected together by at least one strap attached to one side of the plurality of slats such that the table top is operable to roll up when detached from the first and second legs and the support brace.

2. The apparatus of claim 1, wherein the support brace is configured to be positioned between the table top and the first leg and the table top and the second leg.

3. The apparatus of claim 1, wherein:

the support brace is oriented substantially transverse to the plurality of slats when the first bolt is extending through the first longitudinal slot of the support brace and the first slot of the table top and the second bolt is extending through the second longitudinal slot of the support brace and the second slot of the table top.

4. The apparatus of claim 1, wherein:

the plurality of slats includes a first outer slat and a second outer slat;

the first slot in the table top is in the first outer slat;

the second slot in the table top is in the second outer slat; and the first outer slat and the second outer slat form opposing ends of the table top.

5. The apparatus of claim 1, wherein:

the table top further comprises a first recess coincident with the first slot;

the table top further comprises a second recess coincident with the second slot;

the first bolt has a first bolt head;

the first recess is configured to receive the first bolt head;

the second bolt has a second bolt head; and the second recess is configured to receive the second bolt head.

6. The apparatus of claim 1, wherein:

the first bolt includes a first angular stop portion corresponding to the first slot such that the first slot prevents the first bolt from rotating about an axis perpendicular to a plane of the table top when the first angular stop portion is inserted into the first slot; and the second bolt includes a second angular stop portion corresponding to the second slot such that the second slot prevents the second bolt from rotating about the axis perpendicular to the plane of the table top when the second angular portion is inserted into the second slot.

7. The apparatus of claim 1, wherein:

the first bolt is threaded into the first leg;

the second bolt is threaded into the second leg;

the first bolt is adjustable within the first leg to selectively clamp the first leg, the table top, and the support brace together; and the second bolt is adjustable within the second leg to selectively clamp the second leg, the table top, and the support brace together.

8. The apparatus of claim 1, further comprising:

a third slot in the table top, wherein the first slot is at a first corner of the table top, the second slot is a second corner of the table top, and the third slot is at a third corner of the table top; and a third leg having a third bolt, wherein the third slot is configured to receive the third bolt therethrough.

9. The apparatus of claim 8, further comprising:

a fourth slot in the table top, wherein the fourth slot in the table top is at a fourth corner of the table top and the table top is substantially rectangular; and a fourth leg having a fourth bolt, wherein the fourth slot is configured to receive the fourth bolt therethrough.

10. The apparatus of claim 9, further comprising a second support brace having a first end with a first longitudinal slot and a second end with a second longitudinal slot, the first longitudinal slot of the second support brace having a longitudinal length greater than a longitudinal length of the second longitudinal slot of the second support brace, the third bolt positioned in the first longitudinal slot of the second support brace, and the fourth bolt positioned in the second longitudinal slot of the second support brace.

11. The apparatus of claim 1, wherein:

the first leg extends along a longitudinal axis thereof;

the second leg extends along a longitudinal axis thereof;

the first bolt extends longitudinally from the first leg; and the second bolt extends longitudinally from the second leg.

12. A method of constructing a table comprising a tabletop with a plurality of slots, a plurality of legs, and a support brace having a first end with a first longitudinal slot and a second end with a second longitudinal slot, the first longitudinal slot having a longitudinal length greater than a longitudinal length of the second longitudinal slot, the method comprising the steps of:

inserting a first leg of the plurality of legs into a first slot of the plurality of slots;

inserting the first leg into the first longitudinal slot of the support brace;

inserting a second leg of the plurality of legs into a second slot of the plurality of slots; and inserting the second leg into the second longitudinal slot of the support brace, such that the support brace extends across a plurality of slats of the table top, and unrolling the table top, wherein:

the plurality of slats are oriented substantially parallel to one another; and the plurality of slats are connected together by a strap attached to one side of each of the plurality of slats, the slats operable to roll up on one another.

13. The method of claim 12, wherein:

the first leg further comprises a first bolt;

step (a) further comprises inserting the first bolt into the first slot; and step (b) further comprises the first longitudinal slot receiving the first bolt.

14. The method of claim 13, wherein:

the second leg further comprises a second bolt;

step (c) further comprises inserting the second bolt into the second slot; and step (d) further comprises the second longitudinal slot receiving the second bolt.

15. The method of claim 14, further comprising:

centering the support brace between opposing ends of the table top;

tightening the first bolt into the first leg to clamp the first leg, the support brace, and the table top together; and tightening the second bolt into the second leg to clamp the second leg, the support brace, and the table top together.

16. A table apparatus comprising:

a table top having a plurality of slots, wherein the table top further comprises a plurality of slats oriented substantially parallel to one another, each slat of the plurality of slats connected to one another by a strap attached to one side of the slat;

a plurality of legs, each of the plurality of legs being inserted into a corresponding slot in the table top; and a support brace having a first end including a first longitudinal slot, and a second end including a second longitudinal slot, wherein:

the first longitudinal slot has a longitudinal length greater than a longitudinal length of the second longitudinal slot;

a first leg of the plurality of legs is positioned in the first longitudinal slot; and a second leg of the plurality of legs is positioned in the second longitudinal slot.

17. The apparatus of claim 16, wherein the table top is operable to roll up when the plurality of legs are removed from their corresponding slots in the table top.

18. The apparatus of claim 16, wherein the first leg is configured to selectively clamp the support brace between the table top and the first leg, and the second leg is configured to selectively clamp the support brace between the table top and the second leg.

* * * * *